US005465663A

United States Patent [19]

Bayer et al.

[11] Patent Number: 5,465,663

[45] Date of Patent: Nov. 14, 1995

[54] SHEET-GUIDING DRUM FOR PRINTING MACHINES

[75] Inventors: Harald Bayer, Rodgau; Klemens Kemmerer, Seligenstadt, both of Germany

[73] Assignee: MAN Roland Druckmaschinen AG

[21] Appl. No.: 332,695

[22] Filed: Nov. 1, 1994

[30] Foreign Application Priority Data

Nov. 4, 1993 [DE] Germany ..... 43 37 578

[51] Int. Cl.[6] ..... B41F 21/04

[52] U.S. Cl. ..... 101/409; 271/206

[58] Field of Search ..... 101/408, 409, 101/410; 271/206

[56] References Cited

U.S. PATENT DOCUMENTS

| | | | |
|---|---|---|---|
| 3,985,074 | 10/1976 | Bonsch | 101/410 |
| 4,833,989 | 5/1989 | Wieland | 101/410 |
| 5,268,707 | 12/1993 | Katsuma et al. | 101/409 |

FOREIGN PATENT DOCUMENTS

| | | | |
|---|---|---|---|
| 0185965 | 7/1986 | European Pat. Off. | 101/409 |
| 3428668C2 | 2/1986 | Germany . | |
| 3529639 | 2/1987 | Germany | 101/409 |
| 2098966A | 12/1982 | United Kingdom . | |

*Primary Examiner*—Eugene R. Eickholt
*Attorney, Agent, or Firm*—Leydig, Voit & Mayer, Ltd.

[57] ABSTRACT

A sheet-guiding drum for use in printing machines and having gripper links spaced uniformly around the periphery of the drum. Gripper contact strips of the gripper links are adjusted uniformly in order to accommodate different printing material thicknesses. Such adjustment is achieved by the provision of a drive motor in the journal of the drum, the drive motor being connected by a coupling to adjusters which extend radially from the center of the drum. Each adjuster moves a rod axially of the drum and effects radial adjustment of the associated contact strip by virtue of co-acting wedges carried by the rod and the contact strip.

9 Claims, 3 Drawing Sheets

SHEET-GUIDING DRUM FOR PRINTING MACHINES

BACKGROUND OF THE INVENTION

This invention relates to a sheet-guiding drum for use in printing machines, the drum having one or more gripper links which are spaced uniformly around the periphery of the drum and are adjustable to accommodate different printing material thicknesses.

GB 2 098 966 A discloses a device for the positioning (i.e., radial adjustment) of the gripper support of a gripper link of a sheet-guiding cylinder. The adjustment of the gripper support, according to the thickness of the printing material to be processed, is carried out by means of an adjusting rod which is displaceable axially of the cylinder. The contact surfaces of the gripper support and adjusting rod form a thrust wedge drive mechanism acting in such a way that axial displacement of the adjusting rod effects radial adjustment of the gripper support.

DE 3 428 668 C2 discloses a central gripper contact strip adjustment for double-size and multi-ply large guide drums. Means engaging on the gripper supports enable the individual adjustment of each support. Such means are actuated by positioning means which displace the gripper supports as a whole and which are actuated by a central adjusting device. The central adjusting device can be motor-driven and can be controlled from a control console. There is no disclosure as to how the drive is coupled with the adjusting device.

Prior arrangements for the central adjustment of the gripper contact strips are expensive. Moreover, prior publications do not teach how to couple the drive to the central adjusting device.

SUMMARY OF THE INVENTION

The general aim of the present invention is to provide a sheet-guiding drum having a relatively low cost mechanism for effecting central adjustment of gripper contact strips for purposes of accommodating different printing material thicknesses.

In a general sense, the present invention is especially suitable for drums of single size to four-fold size (with reference to a single-size printing cylinder) with a corresponding number of gripper links spaced symmetrically around the periphery of the drum. Synchronous adjustment of the gripper supports of the drum shortens the changeover times and minimizes subjective influences. Furthermore, the adjustment mechanism of the present invention is relatively inexpensive and is capable of automization. The mounting position of the drive for the adjustment mechanism save space, the drive being in the form of an electric motor or a pneumatic or hydraulic actuator.

In more detailed aspects, the transfer of the adjusting movement from the fixed drive is carried out via a coupling to adjusting means carried by the rotating drum. The transfer from the fixed drive to the rotating adjusting means takes place with low play.

From the coupling, the adjusting movement is transmitted by means of adjusting means such as one or more adjusting shafts. For a single-size drum having a single gripper link on its periphery, the adjusting shaft is supported in the region of the drum axis and is coupled at its free end to a positioning device for radially adjusting the gripper contact strip.

For a double-size drum having two gripper links spaced diametrically around its periphery, one adjusting shaft is used as adjusting means. The adjusting shaft, however, extends to and is coupled with the positioning device for both gripper contact strips.

For a triple-size drum having three gripper links or for a quadruple-size drum having four gripper links spaced equally around the periphery of the drum, three or four adjusting shafts are used as adjusting means in such a way that each adjusting shaft is supported in the region of the drum axis and is coupled at its free end to a positioning device.

The adjusting means are connected by means of levers and rollers to only one coupling irrespective of the number of adjusting means and thus the invention is also suitable to drums having more than four gripper links.

Each drum has a separate drive for adjusting the gripper contact strips, the drive being able to be coupled between a plurality of drums or cylinders so that all sheet-guiding drums or cylinders can be controlled from one console. This is advantageous in the case of printing machines having a plurality of printing units since the forward printing units which are allocated to a feeder can be adjusted to a different printing material thickness for the next print job while the last sheets of the preceding print job are still being processed in the last printing units or further processing units. This contributes to further reduction of preparation time and is particularly advantageous in the case of frequently changing print jobs.

These and other objects and advantages of the invention will become more apparent from the following detailed description when taken in conjunction with the accompanying drawings.

Figure 1:
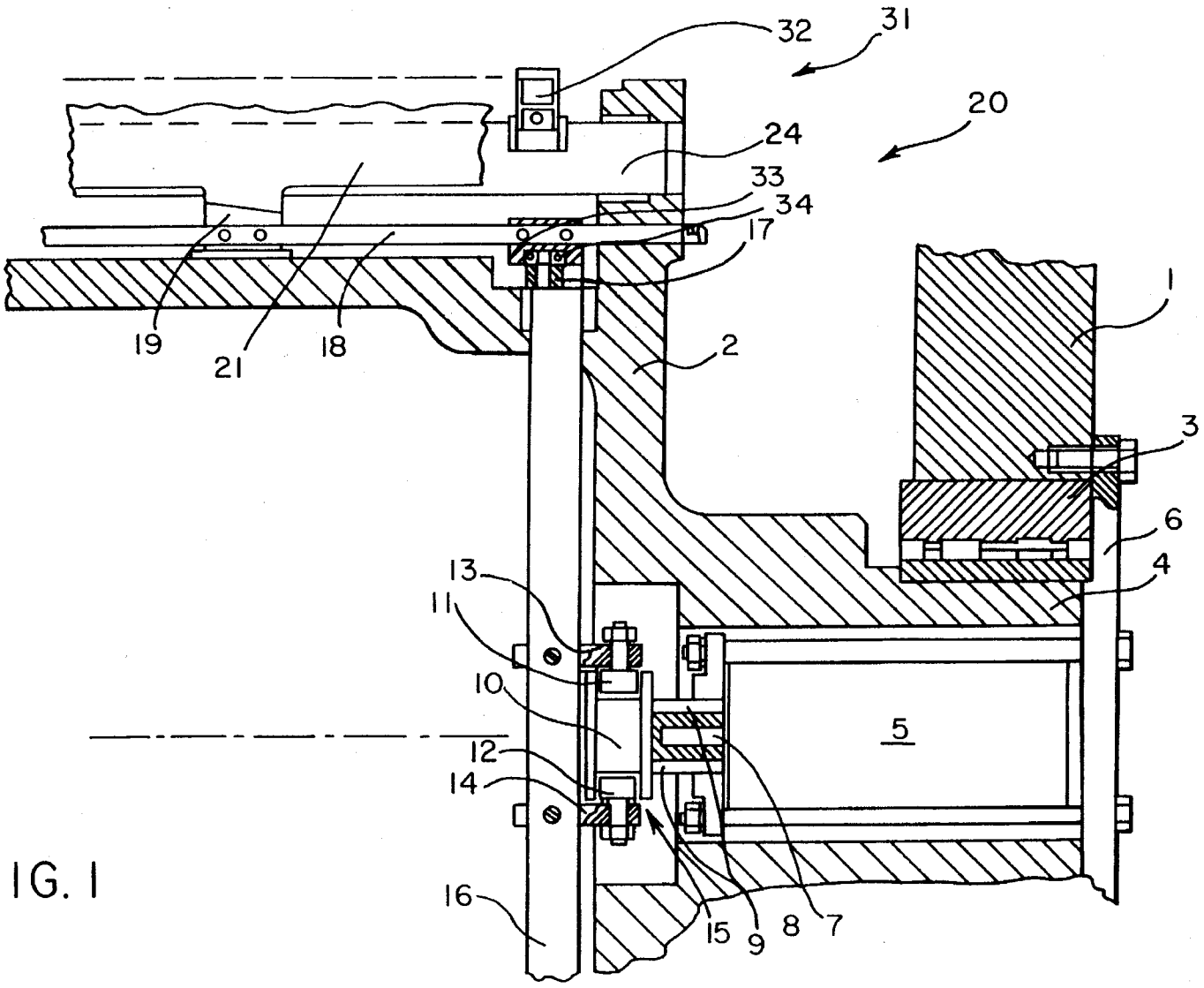
FIG. 1 is a fragmentary front view of a double-size sheet-guiding drum incorporating the features of the invention, certain parts being broken away and shown in section.

While the invention is susceptible of various modifications and alternative constructions, certain illustrated embodiments hereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE PREFERRED EMBODIMENTS

A sheet-guiding drum 2 in an offset rotary printing machine is arranged after the printing cylinder of the preceding printing unit, the printing cylinder of a further printing unit being arranged after the drum 2. The drum 2 shown in FIG. 1 is designed with a double-size diameter, with reference to a single-size printing cylinder, and hence carries two gripper links 31. On the periphery of the drum 2, the two gripper links 31 are positioned symmetrically and thus are spaced diametrically from one another. Each gripper link 31 comprises a gripper shaft 24, grippers 32 and a gripper contact strip 21 which may be adjusted in an approximately radial direction. The gripper contact strip 21 carries, for each gripper 32, an associated support block.

The drum 2 is mounted rotatably at its ends by means of a pair of drum journals 4 in bearings 3 of a frame 1. A drive 5 such as an electric motor is fixed by means of a mounting bracket 6 on the frame 1. The motor is positioned within one drum journal 4 and is aligned with the axis of the drum. An adaptor 8, which has an external thread, is fastened to the output or drive shaft 7 of the motor 5. A connecting link 10 having an internal thread is detachably mounted on the external thread of the adaptor and is coupled with a linear guide 9 fastened on the motor 5. The connecting link 10 has a peripheral groove in which two rollers 11, 12 are guided. The roller 11 is rotatably supported on a lever 13 while the roller 12 is rotatably supported on a lever 14. Both levers 13, 14 are fastened on an adjusting shaft 16. The levers 13, 14 are, in this case, arranged on the adjusting shaft 16 at a specific distance in such a way that the rollers 11, 12 are guided asymmetrically in the peripheral groove of the connecting link 10. A coupling 15 is thus formed between the adjusting shaft 16 and the motor 5 by means of the drive shaft 7, the adaptor 8, the linear guide 9, the connecting link 10, the rollers 11, 12 and the levers 13, 14.

Arranged on each of the ends of the adjusting shaft 16 is a guide 17 which has a roller 34 on its free end, the roller being guided in a connecting link 33. The connecting link 33 is attached to a positioning shaft 18 which is supported to move axially on the drum body 2. Two positioning shafts 18 are located symmetrically on the periphery of the drum 2. Secured to each positioning shaft 18 are several wedge-shaped elements which coact with associated wedge-shaped elements carried by the gripper contact strip 21 to form a sliding joint in the form of a thrust wedge 19. Each wedge-shaped element on the positioning shaft 18 acts as a drive element while each wedge-shaped element of the gripper contact strip 21 acts as a driven element. Each positioning device 20 for the synchronous radial adjusting of the gripper contact strip 21 is thus formed by means of the guide 17, the positioning shaft 18, the connecting link 33 and roller 34, and the thrust wedges 19. The gripper contact strip 21 is spring-loaded against the thrust wedges 19 of the shaft 18.

In operation, the drum 2 takes a printed sheet from the printing cylinder of an upstream printing unit and presents this sheet to the printing cylinder of the downstream printing unit. If a sheet having a different thickness is to be processed, it is necessary to adjust the gripper contact strips 21 radially inwardly or outwardly. This must be carried out synchronously in both gripper links 31. The electric motor 5 is energized from a console and rotates the drive shaft 7. Since the drive shaft 7 is connected to the adaptor 8, the latter also is rotated. The connecting link 10 forms a screw drive with the adaptor 8 and thus is moved linearly when the adaptor is rotated. The connecting link 10 is guided in the linear guide 9 which, for example, may be two parallel round rods, which are fixed on the motor 5. The rollers 11, 12 are guided with low play in the groove of the connecting link 10 in such a way that the rollers 11 and 12 roll on opposite end faces of the groove. The rotary movement of the motor drive shaft 7 is converted into movement of the connecting link 10 in a direction axially of the drum 2 via the adaptor 8 and the linear guide 9. The levers 13, 14 are pivoted via the rollers 11, 12 in such a way that the adjusting shaft 16 is rotated. The rotary movement of the adjusting shaft 16 is transferred synchronously to each positioning shaft 18 via the guide 17 on the end of the shaft 16 and by means of the roller 34 and the connecting link 33. Each shaft 18 is thus moved in the axial direction. The thrust wedges 19 effect the radial movement of the driven element, here the gripper contact strip 21, by means of axial movement of the drive element with the positioning shaft 18. In the case of thin printing material, the gripper contact strips 21 are moved outwardly (raising) and, in the case of thick printing material, are moved correspondingly inwardly (lowering). The position of the gripper strip 21 established by the motor 5 is signaled back to the console.

In the region of the end faces of the drum 2, each positioning shaft 18 projects beyond the drum and carries a scale on its free end. In this way, the position of the gripper contact strips 21 can be read out independently of a display on the console.

Figure 2:
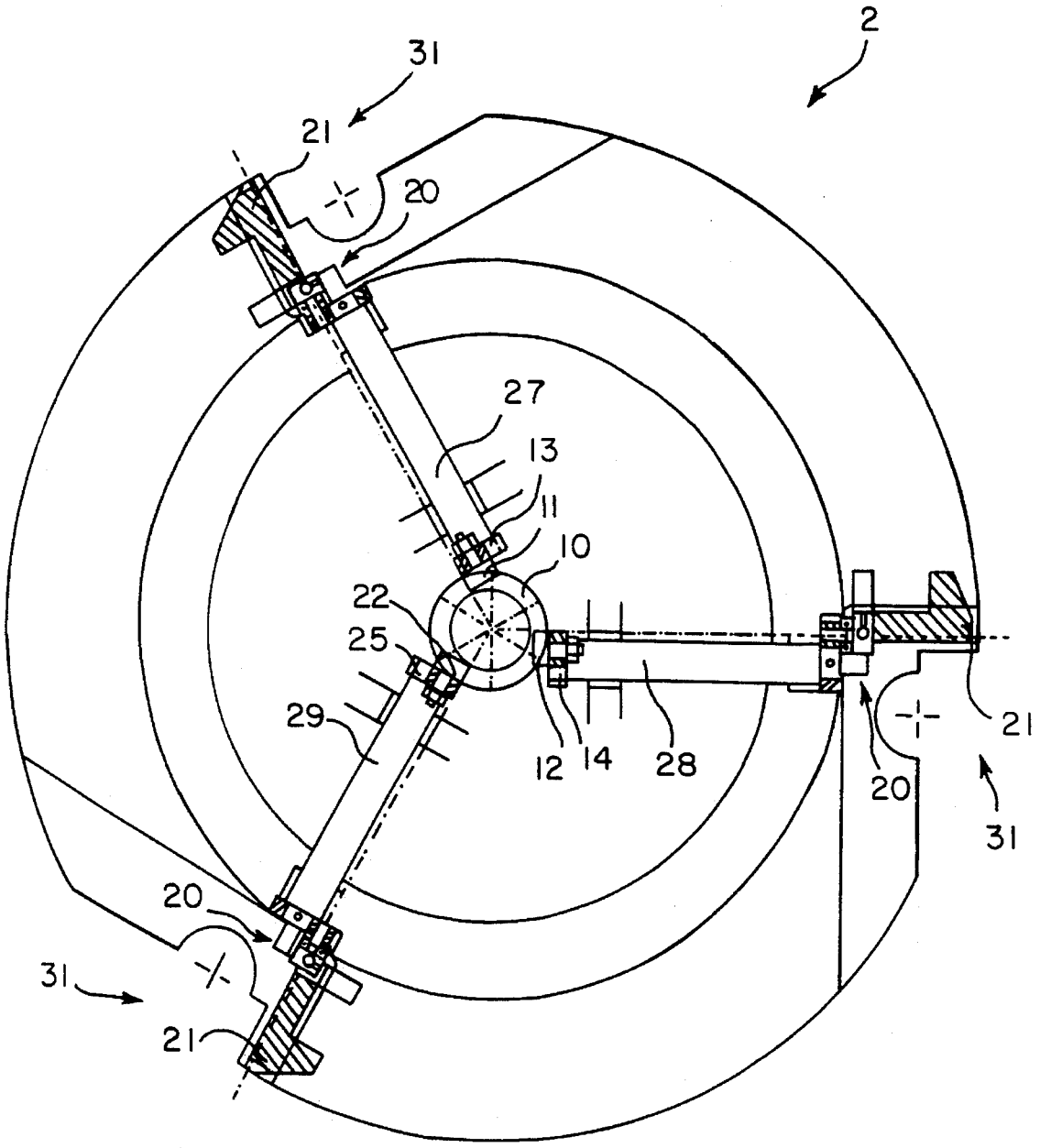
FIG. 2 is a schematic end view of a triple-size drum.

The drum 2 shown in FIG. 2 is designed with a triple-size diameter and carries three gripper links 31 spaced 120° from one another around the periphery of the drum. Each gripper link 31 includes a gripper shaft, grippers, and an adjustable gripper contact strip 21. The connecting link 10 of the triple-size drum 2 is driven in the same manner as the connecting link of the double-size drum. The connecting link 10 has a peripheral groove which guides, in addition to the rollers 11, 12, a further roller 22. The rollers are guided in such a way that each roller 11, 12, 22, offset from each other by approximately 120°, rolls alternately on the opposite end faces of the groove. In addition to the rollers 11, 12 articulated on the levers 13, 14, the roller 22 is articulated on a further lever 25. The levers 13, 14, 25 are fastened on adjusting shafts 27, 28, 29, respectively. In the case of a triple-size drum 2 having three gripper links 31, the adjusting shafts 27, 28 and 29 are arranged symmetrically and are angularly offset by about 120°. Each adjusting shaft 27, 28 and 29 is supported in the region of the axis of the drum 2. Analogous to the double-size drum, a guide 17 is arranged on the free end of each adjusting shaft 27, 28 and 29 and has a roller 34 guided in a connecting link 33. The connecting link 33 is arranged on a positioning shaft 18 which is supported to move axially of the drum body 2. In the case of a triple-size drum 2, three positioning shafts 18 are thus arranged symmetrically around the periphery of the drum. Several wedge-shaped elements are arranged on each positioning shaft 18 as drive elements and form a sliding link in the form of a thrust wedge 19 with associated wedge-shaped elements forming the driven elements of the gripper contact strip 21.

Each positioning device 20 for the synchronous adjustment of the gripper contact strip 21 of the triple-size drum 2 is thus formed by the guide 17, the positioning shaft 18, the connecting link 33 and roller 34, and the thrust wedge 19. Each gripper contact strip 21 is spring-loaded against the thrust wedge 19.

When the connecting link 10 of the triple-sized drum 2 is moved linearly, the levers 13, 14, 25 are pivoted by the rollers 11, 12, 22 in such a way that the adjusting shafts 27, 28, 29 are rotated synchronously about their axes. This rotary movement is transmitted to each positioning shaft 18 via the guide 17 arranged on the end of the adjusting shaft and by means of the roller 34 and the connecting link 33. Thus, all three positioning shafts 18 are moved synchronously in the axial direction. The thrust wedges 19 arranged on the positioning shafts 18 effect, as drive elements, the radial displacement of the gripper contact strips 21 as driven elements. When the displacement process is concluded by stopping the motor 5 and while the drum 2 is running in print operation, the rollers 11, 12, 22 revolve around the groove of the connecting link 10.

Figure 3:
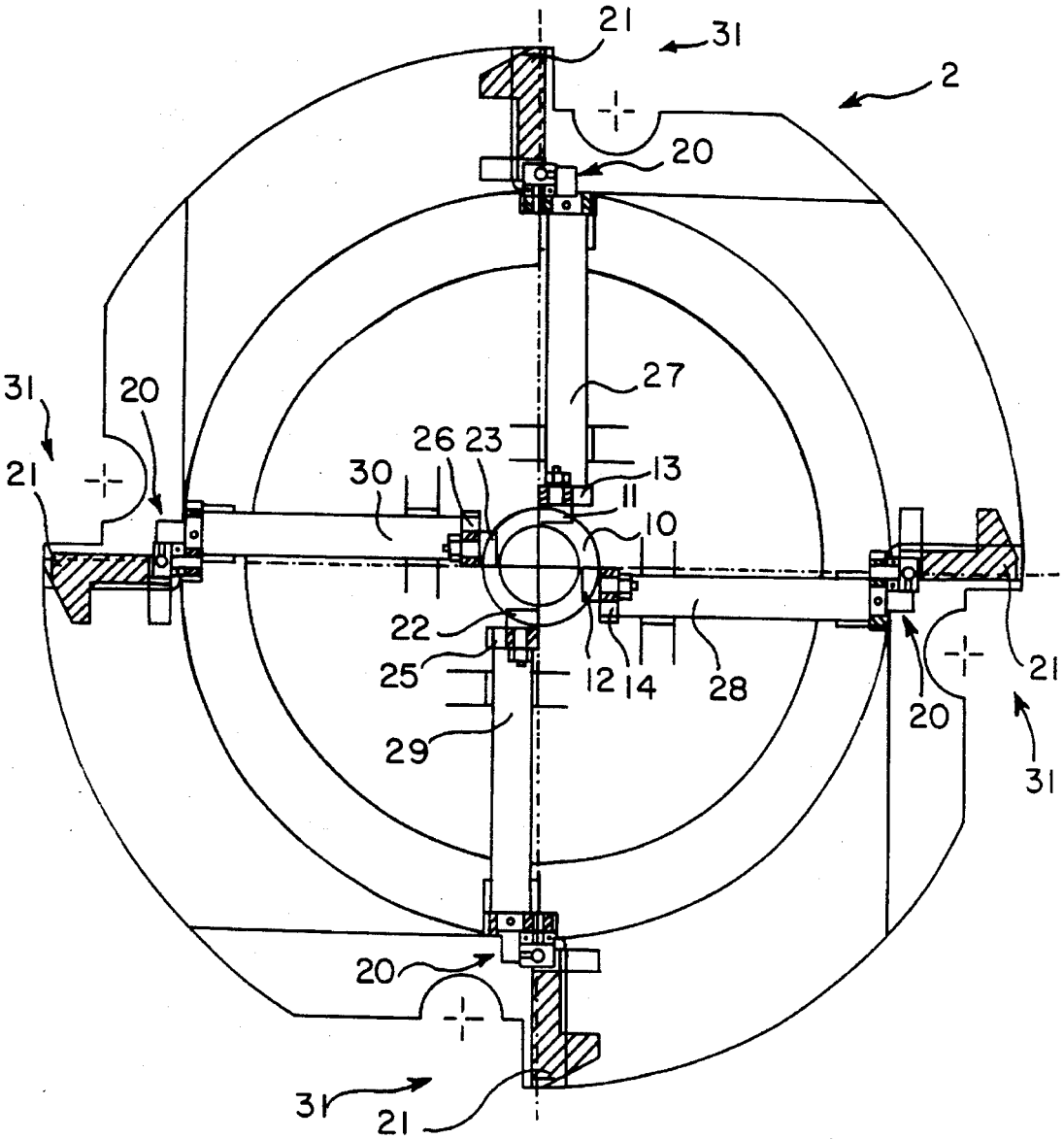
FIG. 3 is a schematic end view of a quadruple-size drum.

FIG. 3 shows a quadruple-size drum 2 having four gripper links 31 arranged symmetrically on its periphery. Four adjusting shafts 27 to 30 (with rollers 11, 12 and 22, 23 and levers 13, 14 and 25, 26) are adjusted by axial movement of the connecting link 10. The adjusting shafts 27 to 30 are offset from one another by approximately 90°. Each adjusting shaft 27 to 30 is supported in the region of the axis of the drum 2 and is coupled at its free end to the positioning device 20 for adjusting the respective gripper contact strip 21.

In the case of a single-size drum 2 having but one gripper link 31, the electric motor 5 is likewise located in the drum journal 4 and is fixed to the frame 1. A coupling 15 between the motor 5 and an adjusting shaft 27 is established as already described in that a roller 11 arranged on the lever 13 rotates in the groove of the link 10. The adjusting shaft 27 is supported in the region of the axis of the drum 2 and is coupled at its free end to the positioning device 20 for raising and lowering the gripper contact strip 21.

We claim:

1. A sheet-guiding drum for use in a printing machine, said drum including at least one gripper link having grippers and having a radially adjustable gripper contact strip, said drum having a journal for rotatably supporting the drum, said drum being characterized by a drive located in said journal and having an output producing motion in a direction non-radially of the drum, and means connected between said output and said gripper contact strip for converting the non-radial motion of said output into radial movement of said gripper contact strip thereby to radially adjust said strip.

2. A sheet-guiding drum as defined in claim 1 in which said drive has a rotary output, said means converting the rotary motion of said output into linear motion along the axis of said drum.

3. A sheet-guiding drum as defined in claim 2 in which said means convert said linear motion to rotary motion along a radius of said drum.

4. A sheet-guiding drum as defined in claim 3 in which said means convert said rotary motion along the radius of said drum into axial motion adjacent said gripper contact strip.

5. A sheet-guiding drum as defined in claim 4 in which said means convert said axial motion to radial movement of said contact strip thereby to radially adjust said strip.

6. A sheet-guiding drum as defined in claim 1 in which said drive includes a rotary output shaft, said means including mechanism for converting rotary motion of said output shaft to linear motion along the axis of said drum, said means further including an adjusting shaft extending radially of said drum to a location adjacent said contact strip and also including means for rotating said adjusting shaft in response to said linear motion.

7. A sheet-guiding drum as defined in claim 6 in which said drum includes a single gripper link and a single adjusting shaft.

8. A sheet-guiding drum as defined in claim 6 in which said drum includes first and second diametrically spaced gripper links, said adjusting shaft having first and second ends located adjacent said first and second gripper links, respectively.

9. A sheet-guiding drum as defined in claim 1 in which said drum includes a plurality of at least three angularly spaced gripper links each having a contact strip, said drive including mechanism for converting rotary motion of said output shaft to linear motion along the axis of said drum, said means further including a plurality of adjusting shafts corresponding in number to the number of gripper links, each of said adjusting shafts extending radially of said drum, having one end located adjacent said mechanism and having an opposite end located adjacent the contact strip of a respective one of said gripper links, said means also including means for rotating said adjusting shafts in response to said linear motion.

* * * * *